US007396241B2

(12) United States Patent
Matsuura et al.

(10) Patent No.: US 7,396,241 B2
(45) Date of Patent: Jul. 8, 2008

(54) METHOD OF PRODUCING LEVER OF LEVER-FITTING TYPE CONNECTOR

(75) Inventors: Yoshinori Matsuura, Makinohara (JP); Hiroaki Yamagishi, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/775,590

(22) Filed: Jul. 10, 2007

(65) Prior Publication Data

US 2008/0020613 A1 Jan. 24, 2008

(30) Foreign Application Priority Data

Jul. 20, 2006 (JP) ..... 2006-197861

(51) Int. Cl.
*H01R 13/62* (2006.01)

(52) U.S. Cl. ..... 439/157

(58) Field of Classification Search ..... 439/157, 439/160, 372

See application file for complete search history.

(56) References Cited

U.S. PATENT DOCUMENTS 6,190,187 B1 * 2/2001 Okabe et al. ..... 439/157
6,325,647 B1 * 12/2001 May et al. ..... 439/157
7,238,050 B2 * 7/2007 Sakakura et al. ..... 439/610
7,300,294 B2 * 11/2007 Fukatsu et al. ..... 439/157

FOREIGN PATENT DOCUMENTS

JP 2005-122942 A 5/2005

* cited by examiner

*Primary Examiner*—Phuong Dinh
(74) *Attorney, Agent, or Firm*—Sughrue Mion, PLLC

(57) ABSTRACT

There is disclosed a method of producing a lever including a pair of side plates, an interconnecting portion interconnecting one ends of the two side plates, a lock arm formed at the interconnecting portion so as to be engaged with a male connector, excessive displacement prevention piece portions formed on and projecting respectively from opposite side portions of the lock arm, and a pair of displacement limitation ribs which are formed respectively at opposite ends of the interconnecting portion, and project in a direction away from the side plates, and are disposed outwardly respectively of the excessive displacement prevention piece portions, each excessive displacement prevention piece portion is disposed between the corresponding displacement limitation rib and the interconnecting portion, and thereafter the bent interconnecting portion is restored into its initial shape, thereby canceling the expansion of the gap between the displacement limitation ribs.

3 Claims, 12 Drawing Sheets

METHOD OF PRODUCING LEVER OF LEVER-FITTING TYPE CONNECTOR

BACKGROUND OF THE INVENTION

1. Field of the Invention

This invention relates to a method of producing a lever of a lever-fitting type connector in which by pivotally moving the lever mounted on a female connector, a male connector is fitted to the female connector.

2. Related Art

There has been proposed a conventional lever-fitting type connector disclosed in JP-A-2005-122942 Publication. As shown in FIGS. 11 and 12, the lever-fitting type connector 101 disclosed in JP-A-2005-122942 comprises a male connector 103 having fitting hood portions 102*a* and 102*b*, a female connector 105 having a female connector body 104 for fitting to the fitting hood portions 102*a* and 102*b*, and a lever 106 which is pivotally mounted on the female connector 105 and is pivotally moved so as to bring the male connector 103 into and out of fitting engagement with the female connector 105.

By fitting the female connector boy 104 into the fitting hood portions 102*a* and 102*b*, male terminals received in the male connector 103 are connected respectively to female terminals received in the female connector 105, and by disengaging the female connector body 104 from the fitting hood portions 102*a* and 102*b*, the male terminals are disconnected respectively from the female terminals. In this case, an insertion force required for inserting the female connector 105 into the male connector 103 can be reduced by leverage achieved by the lever 106.

The connector 101 includes a waterproof hood portion 108 provided at the outer periphery of the female connector body 104, and this waterproof hood portion 108 covers the fitting hood portions 102*a* and 102*b* when the female connector housing 104 are fitted in the fitting hood portions 102*a* and 102*b*. The lever 105 is pivotally mounted on an outer peripheral surface of this waterproof hood portion 108, and the lever 106 has fulcrum projections 109 which extend through the waterproof hood portion 108 to project toward the female connector body 104. Fulcrum retaining portions 110 for respectively retaining the fulcrum projections 109 are provided at the fitting hood portion 102 (102*a*, 102*b*) of the male connector 103. The fulcrum retaining portion 110 comprises an insertion-purpose fulcrum retaining projection 113 and a disengagement-purpose fulcrum retaining projection 114 both of which are provided at the hood portion 102*b*.

The lever 106 has a generally U-shape defined by a pair of lever side plates 139 and 139 and an interconnection operating portion 140 which interconnects one ends of these lever side plates 139 and 139 and is manipulated for pivotally moving the lever 106. Holding piece portions 141 and 141 are formed respectively at the other ends of the pair of side plates 139 and 139. The fulcrum projections 109 and 109 are formed respectively on those portions of the side plates 109 and 109 disposed near respectively to the holding piece portions 141 and 141, and project inwardly (toward each other). When the lever 106 is pivotally supported on the female connector body 104, these fulcrum projections 109 and 109 extend through respective window portions (not shown) of the waterproof hood portion 108*b*, and project toward the female connector body 104*b*, and can be retainingly engaged with the insertion-purpose fulcrum retaining projections 113 and with the disengagement-purpose retaining projections 114.

Slot-like pivot holes 142 are formed respectively through intermediate portions of the pair of lever side plates 139 and 139. Pivot shafts 136 are inserted respectively in these pivot holes 142, so that the lever 106 is pivotally supported on the female connector body 104. Further, slide guide projections 116 and 116 are formed respectively on the pair of lever side plates 139 and 139, and project inwardly. When the lever 106 is pivotally supported on the waterproof hood portion 108*b*, these slide guide projections 116 and 116 extend through respective window portions (not shown), and project toward the female connector body 104*a*, and abut against respective lever slide abutment projections 117, and are guided respectively by these projections 117. Provisionally-retaining arms 144 and 114 of an elastic nature are provided respectively at those portions of the pair of lever side plates 139 and 139 disposed near to the interconnection operating portion 140. When the lever 106 is pivotally supported on the female connector body 104*b*, these provisionally-retaining arms 144 and 144 abut against respective provisionally-retaining step portions 138 of the waterproof hood portion 108*a* to hold the lever 106 in a provisionally-retaining position relative to the female connector 105.

The interconnection operating portion 140 includes an interconnecting portion 145 interconnecting one sides of the pair of lever side plates 139 and 139, a lock arm 146 provided inwardly of this interconnecting portion 145, and operating surfaces 147 and 147 formed respectively on upper end surfaces of the pair of lever side plates 139 and 139. The lock arm 146 has a frame-like shape, and opposite sides of an upper portion of the lock arm 146 are integrally connected respectively with the inner surfaces of the pair of lever side plates 139 and 139, and a lock frame portion 148 is formed at a central portion of a lower portion of the lock arm 146. When the lever 106 is pivotally moved from the provisionally-retaining position to a completely-retaining position, the interconnecting portion 145 is disposed outwardly of the waterproof hood portion 108*a*, and the lock arm 146 is inserted in a lever holding portion 143. Also, a lock projection 121 of the hood portion 102*a* is engaged with the lock frame portion 148.

In the above connector, the interconnecting portion 145 formed between the side plates 139 and 139 interconnects the pair of side plates 139 and 139 to form the U-shaped frame body, and also prevents the lock arm 146 from being excessively deformed when the lock arm 146 is caught by a wire or others. However, the lock arm 146 is thus formed inwardly of the interconnecting portion 145 in contiguous relation thereto, and therefore a mold for injection molding the lever 106 into the integral construction is complicated in structure, and particularly a mold section for molding the lock arm 146 has a small size, and therefore there has been a fear that the mold might be broken.

And besides, the mold has such a construction that the mold section for forming the lock arm 146 is disposed inwardly of a mold section for forming the interconnecting portion 145, and therefore a space for receiving the mold section for the lock arm 146 need to be provided inwardly of the mold section for the interconnecting portion 145, and the small-size design of the lock arm has been limited.

SUMMARY OF THE INVENTION

It is an object of this invention to solve the above problems, and more specifically to provide a lever-producing method in which in the production of a lever of a lever-fitting connector, there is no fear that a mold section for molding a lock arm is not broken, and also a small-size design of the lock arm can be achieved.

The above object of the present invention has been achieved by the following construction.

(1) A method of producing a lever for use in a lever-fitting type connector comprising a female connector including a female outer housing having a female inner housing inserted therein, a male connector including a male housing for fitting to the female outer housing, and the lever which is pivotally mounted on the female connector and is pivotally moved so as to bring the male connector into and out of fitting engagement with the female connector;

wherein the lever includes a pair of side plates, an interconnecting portion interconnecting one ends of the two side plates, a lock arm formed at the interconnecting portion so as to be engaged with the male connector, excessive displacement prevention piece portions formed on and projecting respectively from opposite side portions of the lock arm, and a pair of displacement limitation ribs which are formed respectively at opposite ends of the interconnecting portion, and project in a direction away from the side plates, and are disposed outwardly respectively of the excessive displacement prevention piece portions; the method being characterized in that:

the lever is injection molded in such a manner that those portions of the lock arm at which the excessive displacement prevention piece portions are formed, respectively, are disposed outwardly respectively of the displacement limitation ribs; and free ends of the side plates of the molded lever are moved toward each other so as to bend the interconnecting portion, thereby increasing a gap between the pair of displacement limitation ribs; and the portions having the respective excessive displacement prevention piece portions formed thereon are pushed to be disposed inwardly respectively of the displacement limitation ribs, so that each excessive displacement prevention piece portion is disposed between the corresponding displacement limitation rib and the interconnecting portion, and thereafter the bent interconnecting portion is restored into its initial shape, thereby canceling the expansion of the gap between the displacement limitation ribs.

(2) A lever for use in a lever-fitting type connector comprising a female connector including a female outer housing having a female inner housing inserted therein, a male connector including a male housing for fitting to the female outer housing, and the lever which is pivotally mounted on the female connector and is pivotally moved so as to bring the male connector into and out of fitting engagement with the female connector; characterized in that:

the lever includes a pair of side plates, an interconnecting portion interconnecting one ends of the two side plates, a lock arm provided at the interconnecting portion so as to be engaged with the male connector, excessive displacement prevention piece portions formed on and projecting respectively from opposite side portions of the lock arm, and a pair of displacement limitation ribs which are formed respectively at opposite ends of the interconnecting portion, and project in a direction away from the side plates, and are disposed outwardly respectively of the excessive displacement prevention piece portions; and the lever is injection molded in such a manner that those portions of the lock arm at which the excessive displacement prevention piece portions are formed, respectively, are disposed outwardly respectively of the displacement limitation ribs; and free ends of the side plates of the molded lever are moved toward each other so as to bend the interconnecting portion, thereby increasing a gap between the pair of displacement limitation ribs; and the portions having the respective excessive displacement prevention piece portions formed thereon are pushed to be disposed inwardly respectively of the displacement limitation ribs, so that each excessive displacement prevention piece portion is disposed between the corresponding displacement limitation rib and the interconnecting portion, and thereafter the bent interconnecting portion is restored into its initial shape, thereby canceling the expansion of the gap between the displacement limitation ribs.

In the construction of the above Paragraphs (1) and (2), the lock arm is molded in such a manner that the excessive displacement prevention piece portions are disposed outwardly respectively of the displacement limitation ribs, and therefore there is a sufficient space for mold portions for molding the excessive displacement prevention piece portions, and therefore pieces or dies can be increased in size. Therefore, the strength of the mold will not be decreased in contrast with a mold employing small pieces, and there is no fear that the mold may be broken. And besides, the mold can be easily produced since it is not necessary to use small pieces, and the production cost of the mold can be reduced. Furthermore, since the excessive displacement prevention piece portions are molded to be disposed outwardly respectively of the position limitation ribs (displacement limitation ribs), a space for receiving the mold section for the excessive displacement prevention piece portions 72 does not need to be secured within a mold section for the displacement limitation ribs, and accordingly the lock arm can be made smaller.

(3) The lever of the lever-fitting type connector as defined in the above Paragraph (2) is characterized in that the lock arm includes a support shaft portion formed on and projecting from the interconnecting portion, an extension portion extending from the support shaft portion in a connecting fitting direction, a turned-back extension portion extending in a turned-back manner from an extremity of the extension portion in an anti-fitting direction, and an operating portion formed at an extremity of the turned-back extension portion, and the excessive displacement prevention piece portions are formed respectively on those portions of the turned-back extension portion which are offset from the support shaft portion in the anti-fitting direction.

In the construction of the above Paragraph (3), those portions of the lock arm at which the respective excessive displacement prevention piece portions are formed are offset or spaced from the shaft portion, and therefore a stress, developing when pushing the excessive displacement prevention piece portions, can be absorbed by the turned-back extension portion and the extension portion, and therefore the stress acting on the support shaft can be reduced, and there is no fear that the support shaft may be broken.

In the present invention, the lever is molded in such a manner that the excessive displacement prevention piece portions of the lock arm are disposed outwardly respectively of the displacement limitation ribs, and therefore there is a sufficient space for receiving the mold section for molding the excessive displacement prevention piece portions, and the pieces or dies can be made larger in size, and the strength of the mold will not be reduced, and there is no fear that the mold may be broken.

And besides, the mold does not need to have small pieces, and therefore the mold can be produced easily, and the production cost of the mold can be reduced. Furthermore, a space for receiving the mold section for the excessive displacement prevention piece portions does not need to be secured within the mold section for the displacement limitation ribs, and accordingly the lock arm can be made smaller.

DETAILED DESCRIPTION OF THE PREFERRED EMBODIMENTS

One preferred embodiment of the present invention will now be described with reference to the accompanying drawings.

Figure 1:
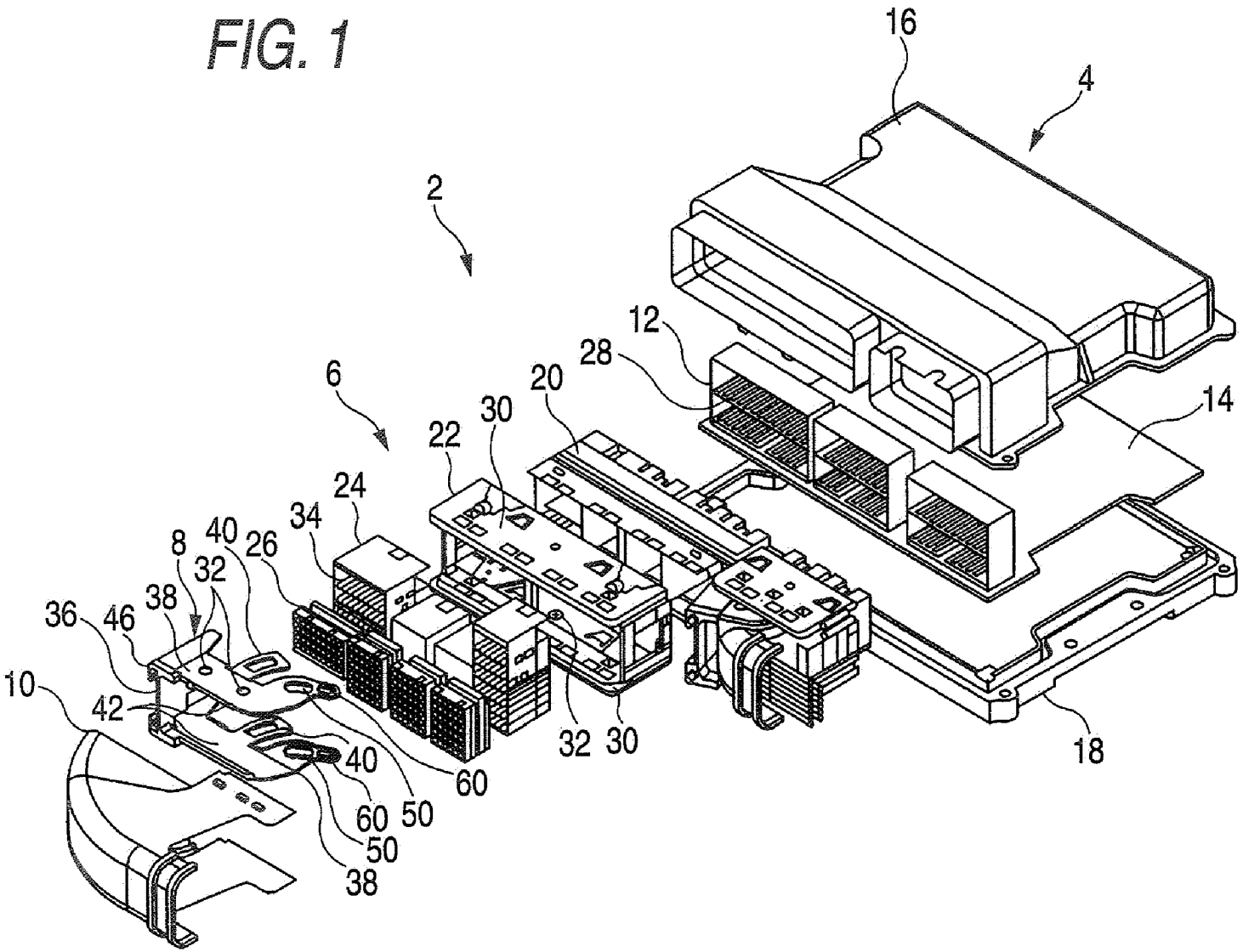
FIG. 1 is an exploded, perspective view of a preferred embodiment of a lever-fitting type connector of the present invention.
Figure 2:
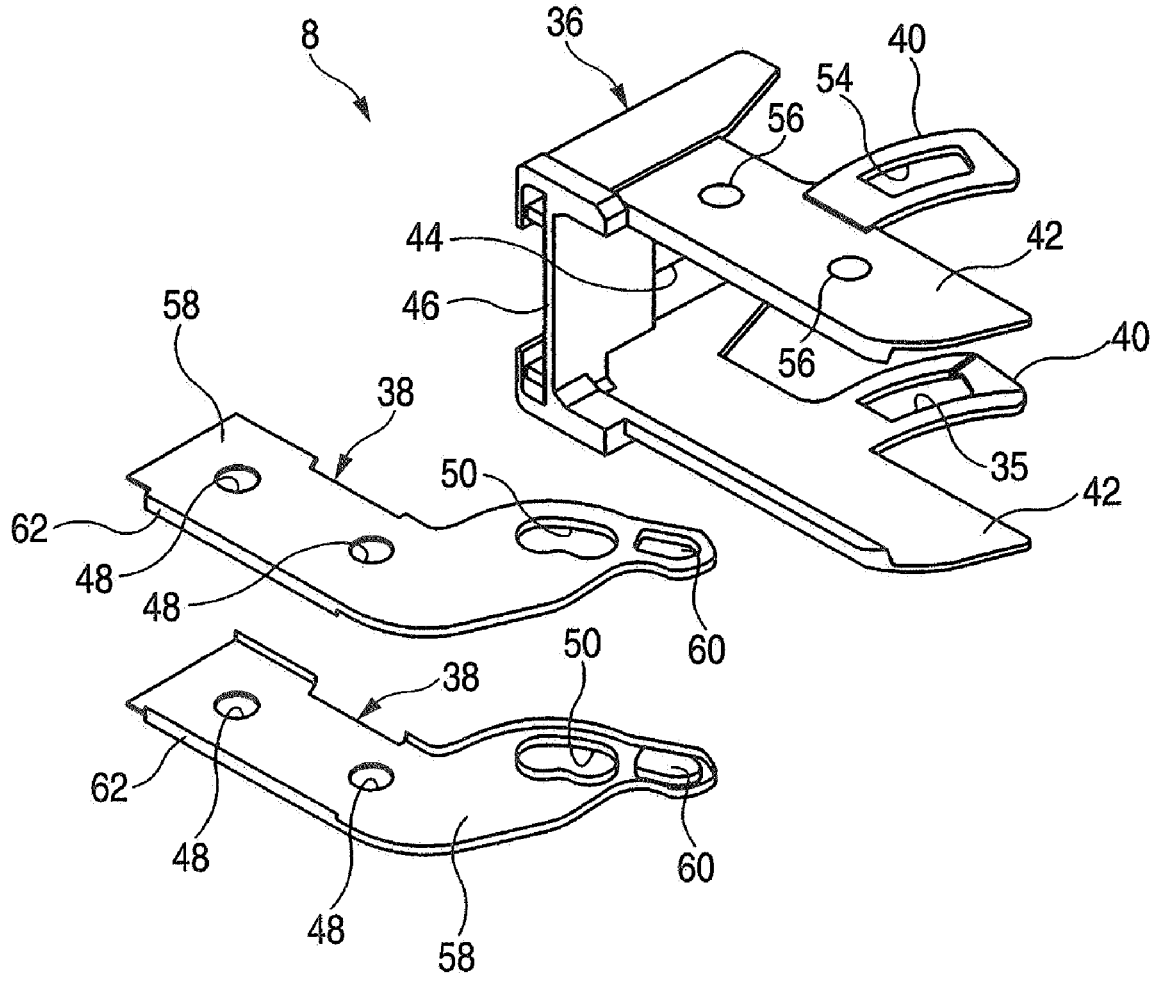
FIG. 2 is an exploded, perspective view of a lever.
Figure 3:
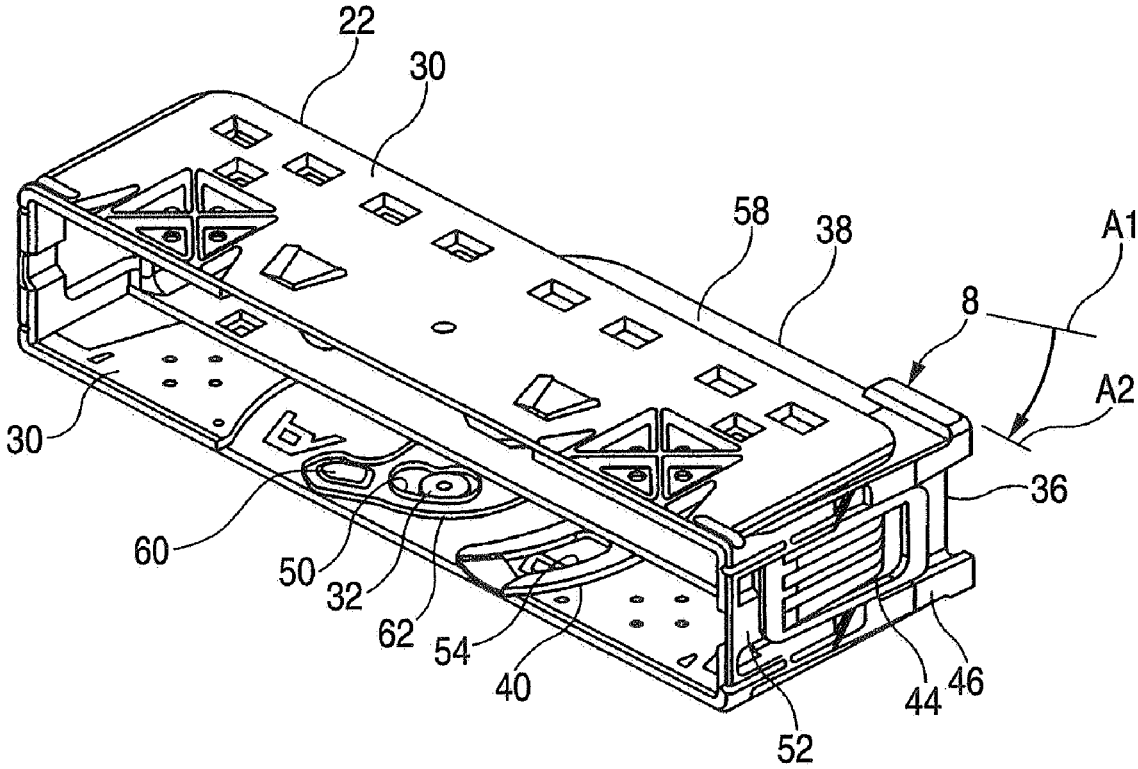
FIG. 3 is a perspective view of a female connector having the lever mounted thereon.
Figure 4:
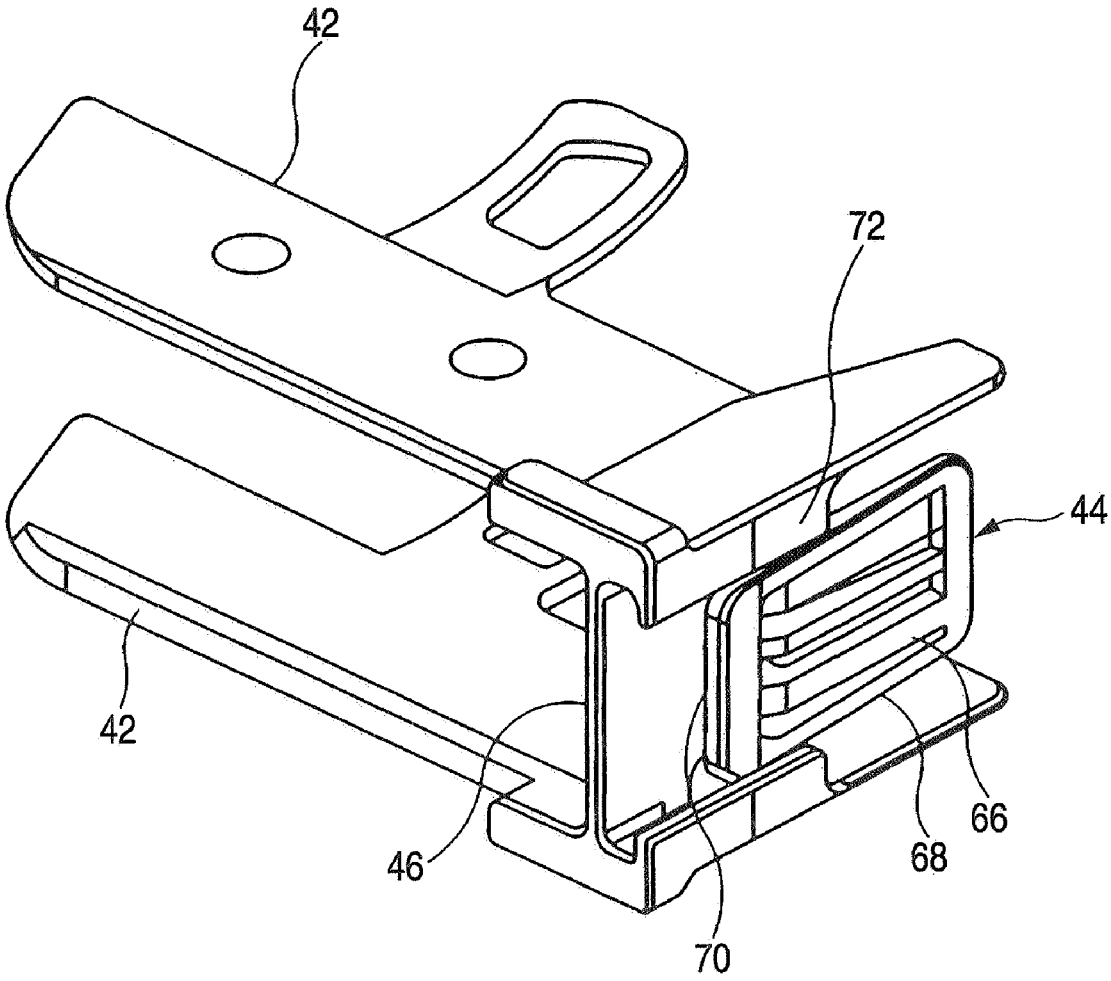
FIG. 4 is a perspective view of the lever, showing a condition after a lock arm is fixed.
Figure 5:
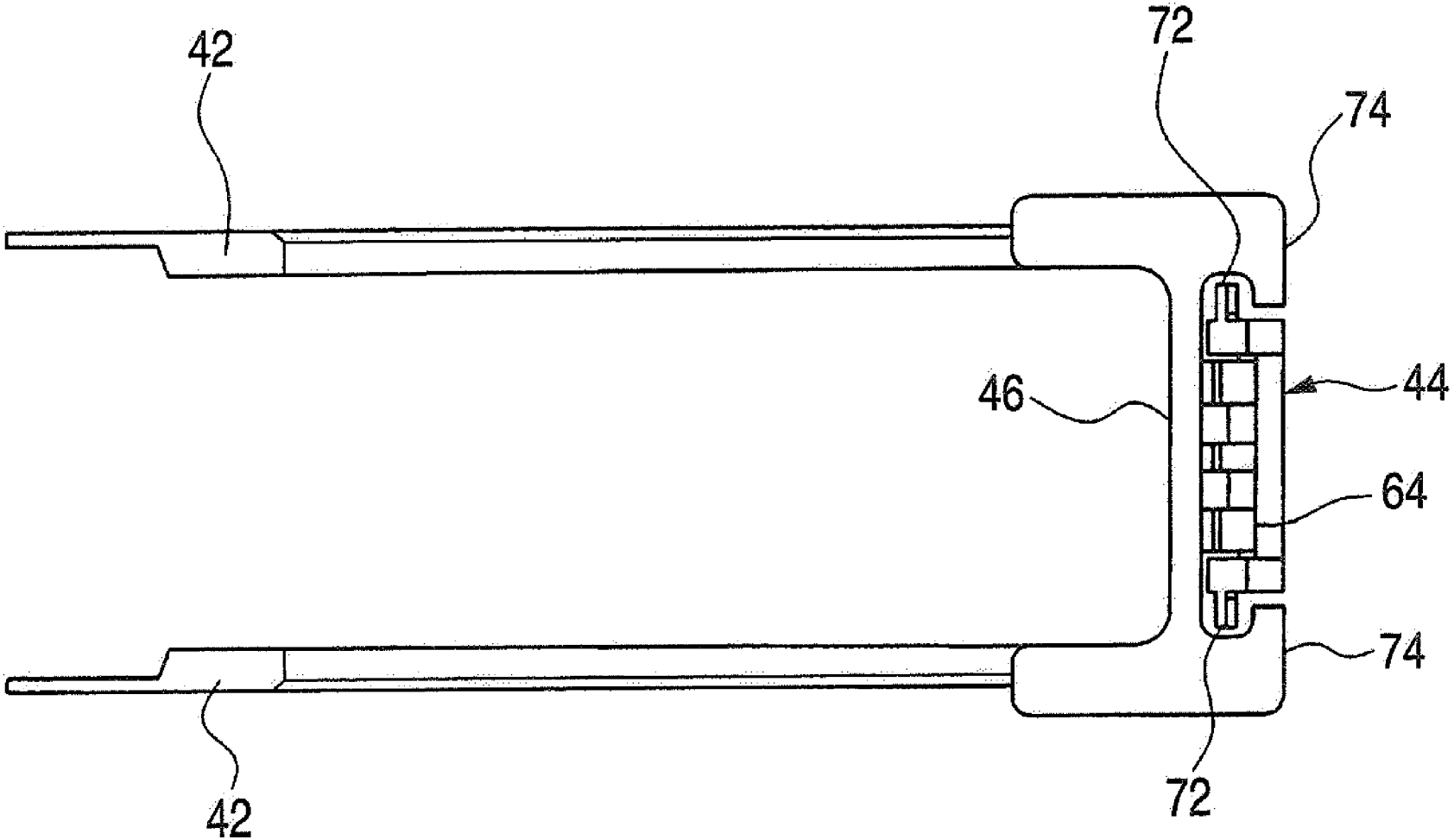
FIG. 5 is a front-elevational view of the lever of FIG. 4.
Figure 6:
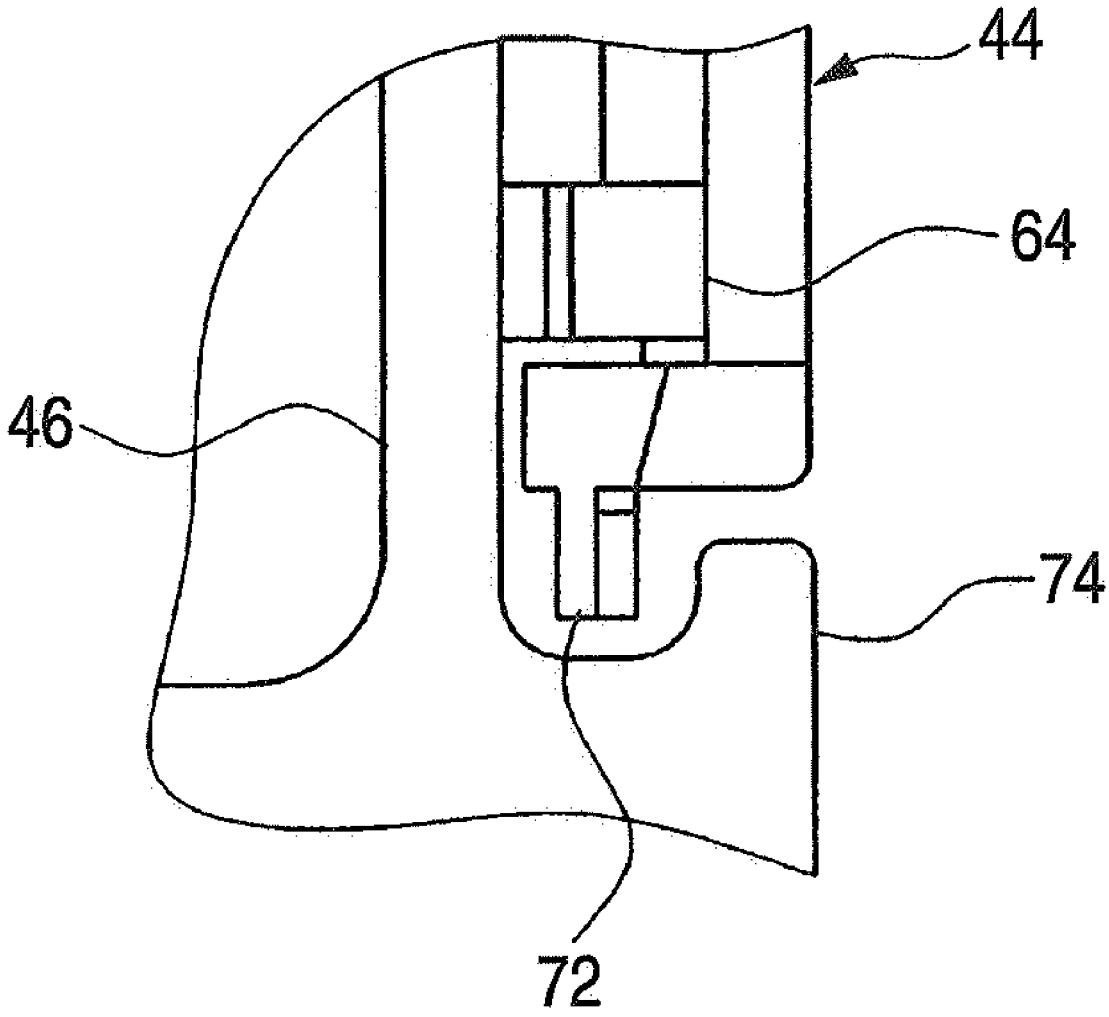
FIG. 6 is an enlarged view of a portion of the lever in the vicinity of the lock arm of FIG. 5.
Figure 7:
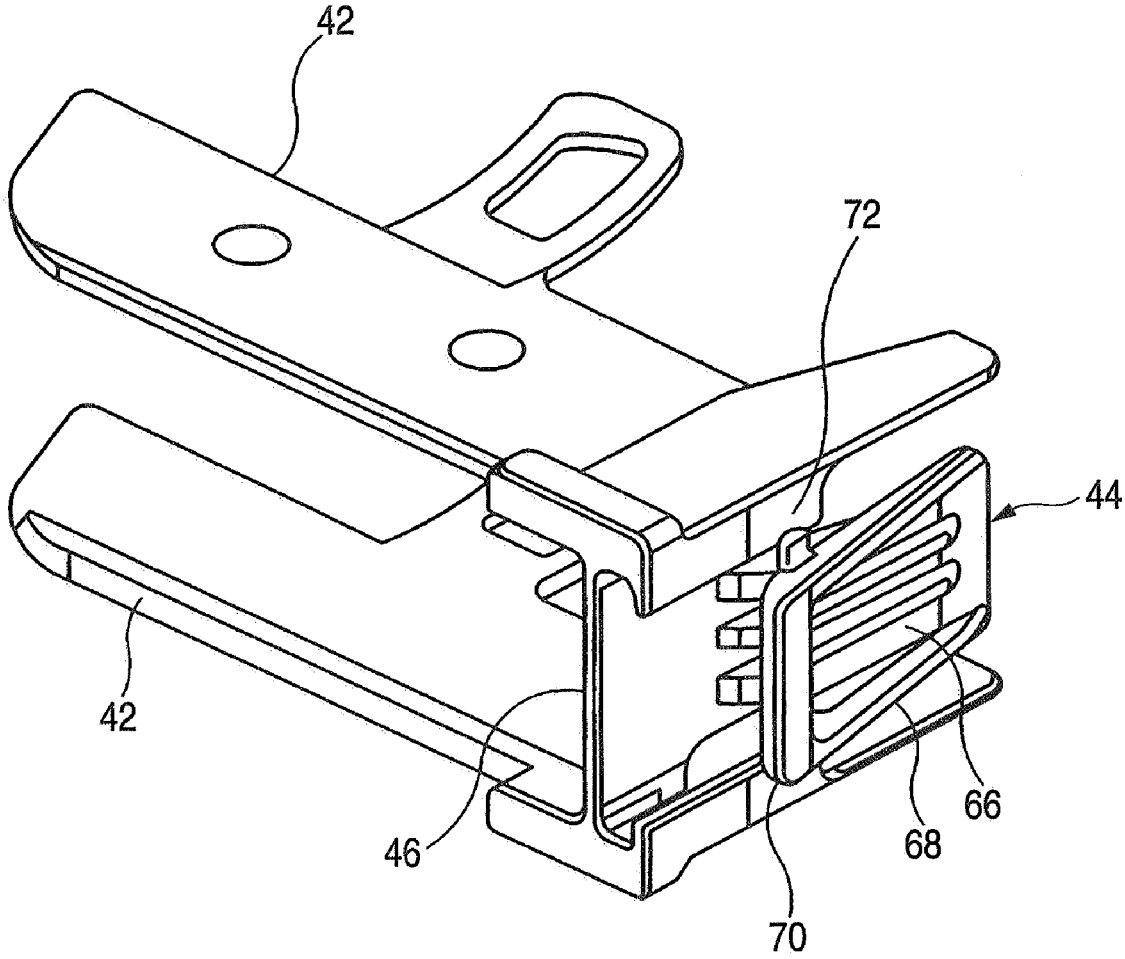
FIG. 7 is a perspective view of the lever, showing a condition before the lock arm is fixed.
Figure 8:
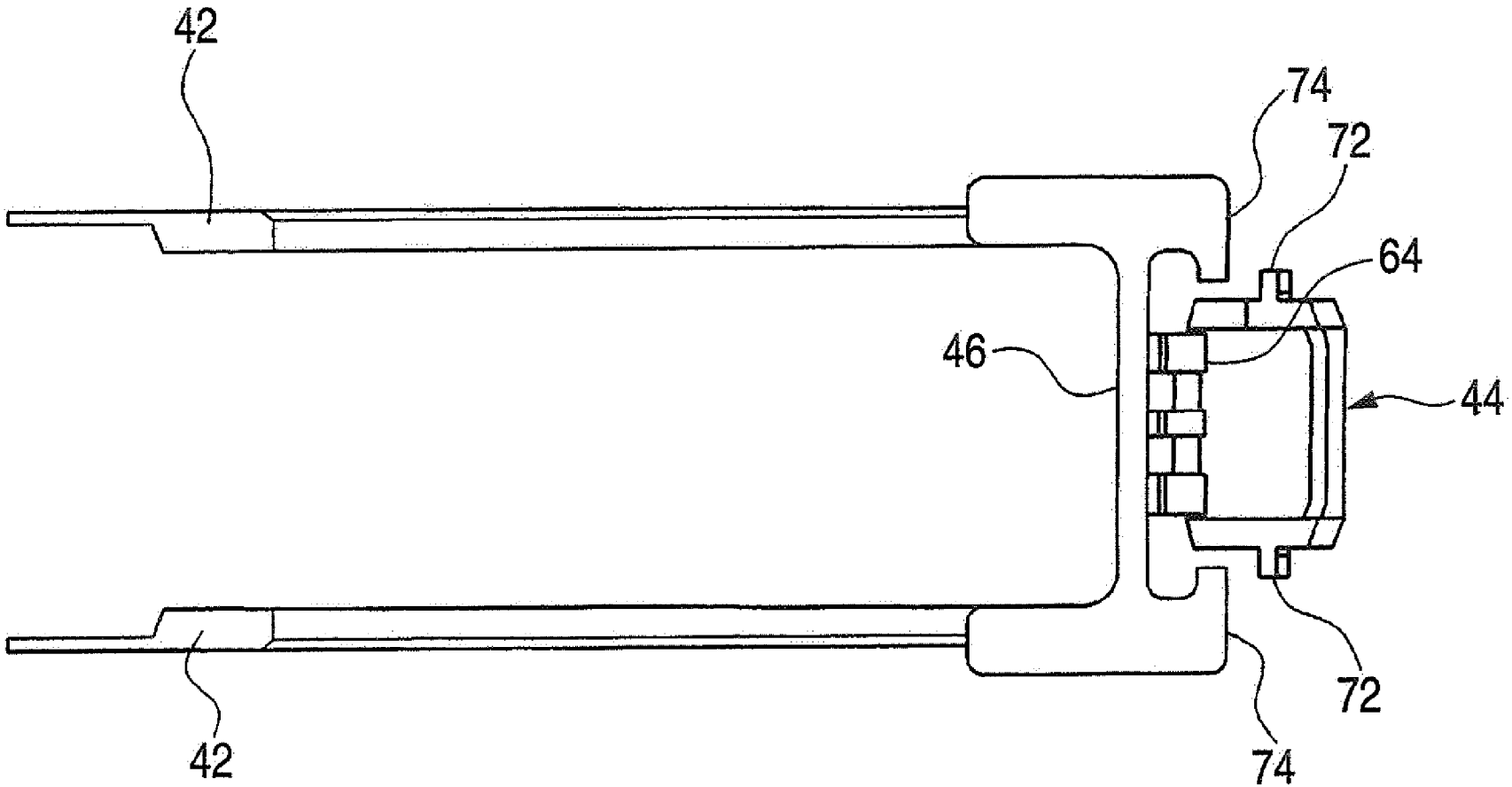
FIG. 8 is a front-elevational view of the lever of FIG. 7.
Figure 9:
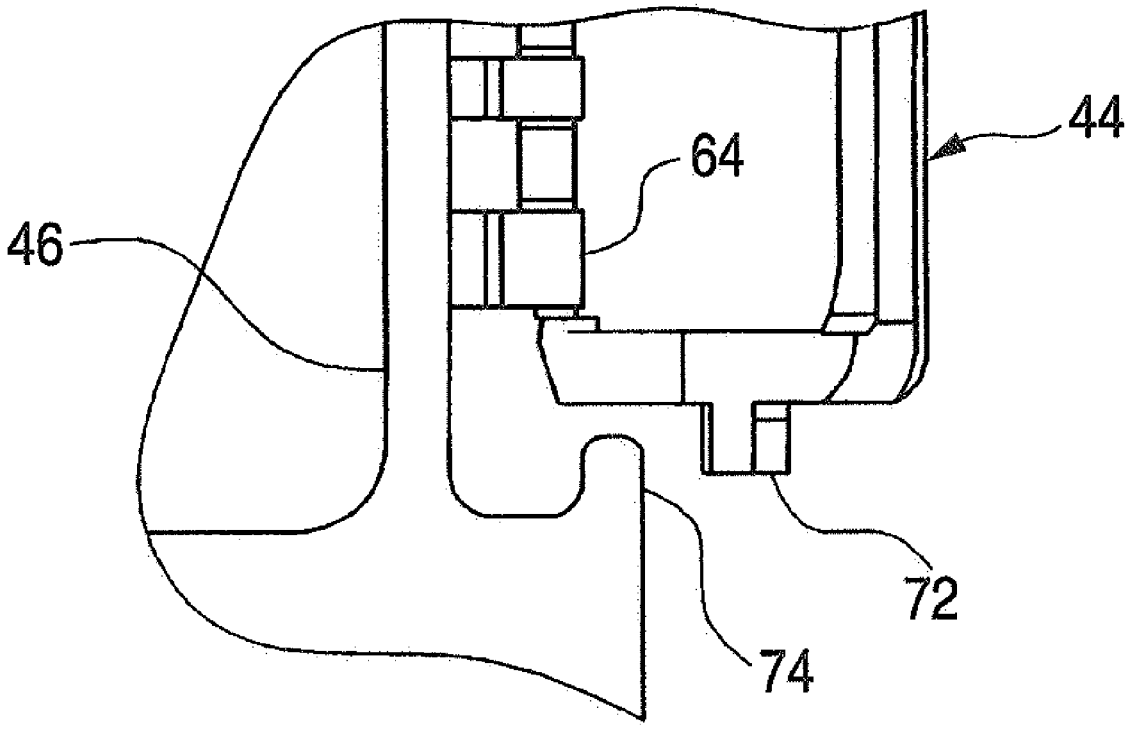
FIG. 9 is an enlarged view of a portion of the lever of FIG. 8 in the vicinity of the lock arm.
Figure 10:
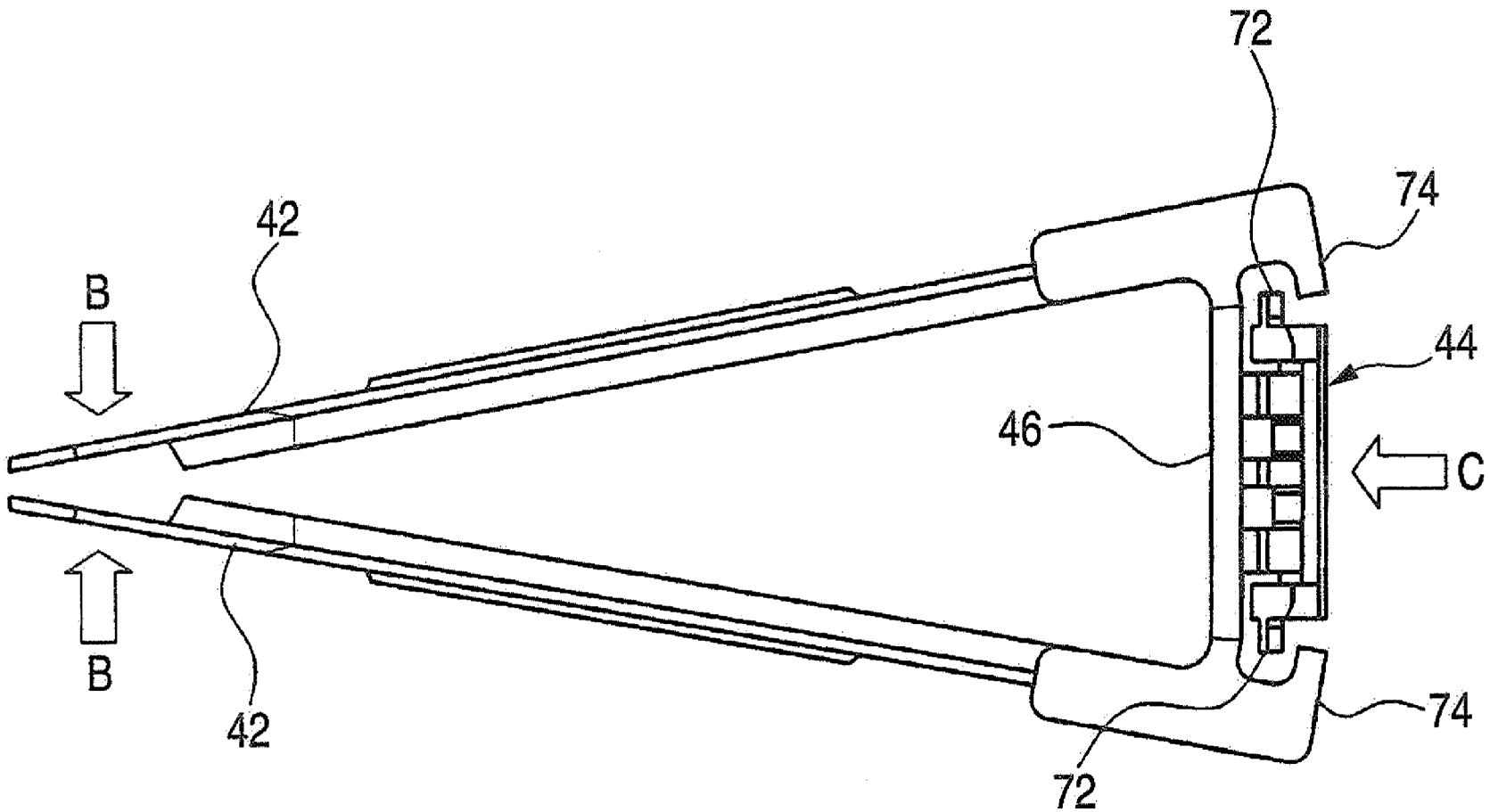
FIG. 10 is a front-elevational view of the lever in its deformed condition.
Figure 11:
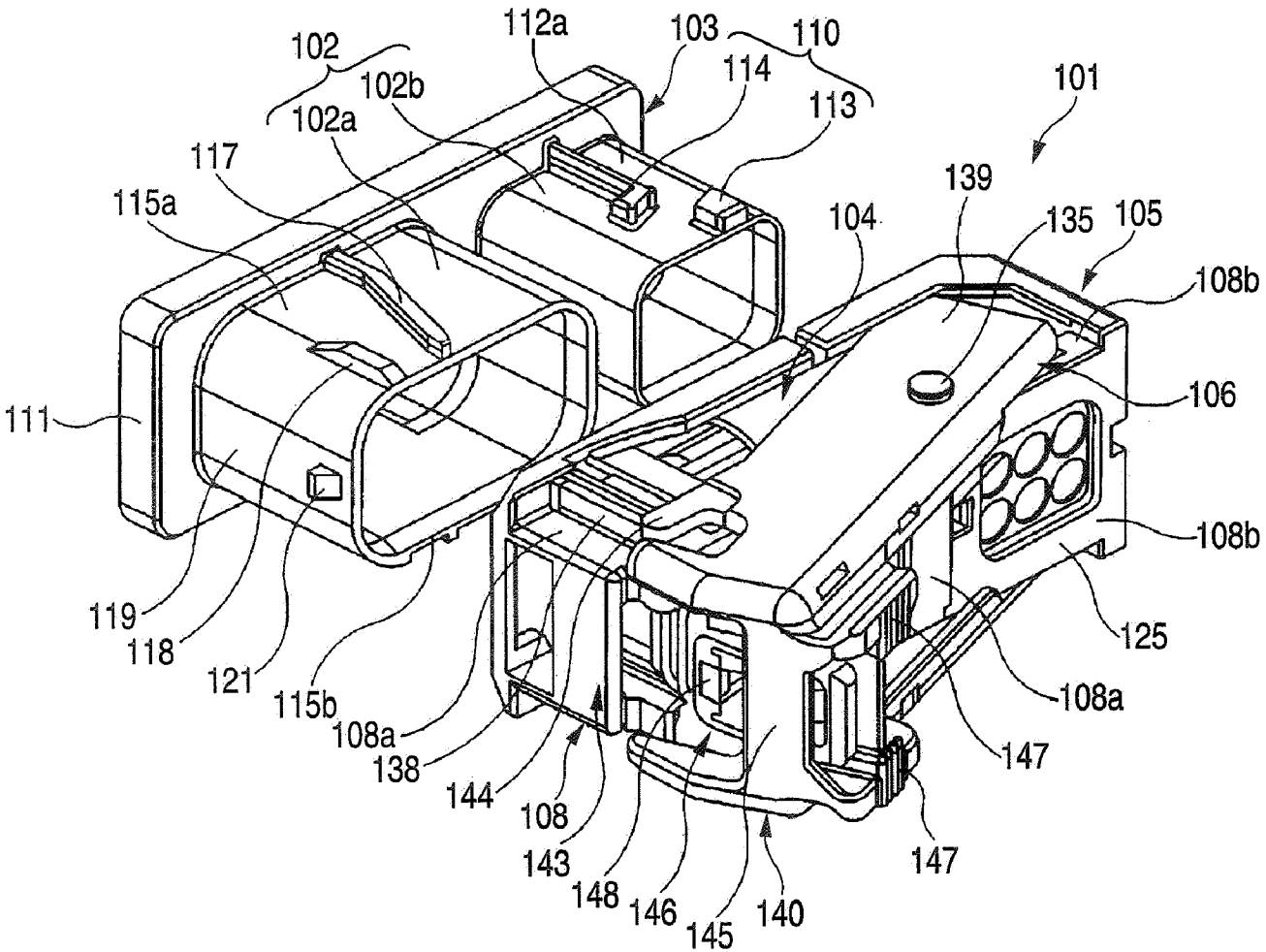
FIG. 11 is a perspective view of a lever-fitting type connector disclosed in JP-A-2005-122942.
Figure 12:
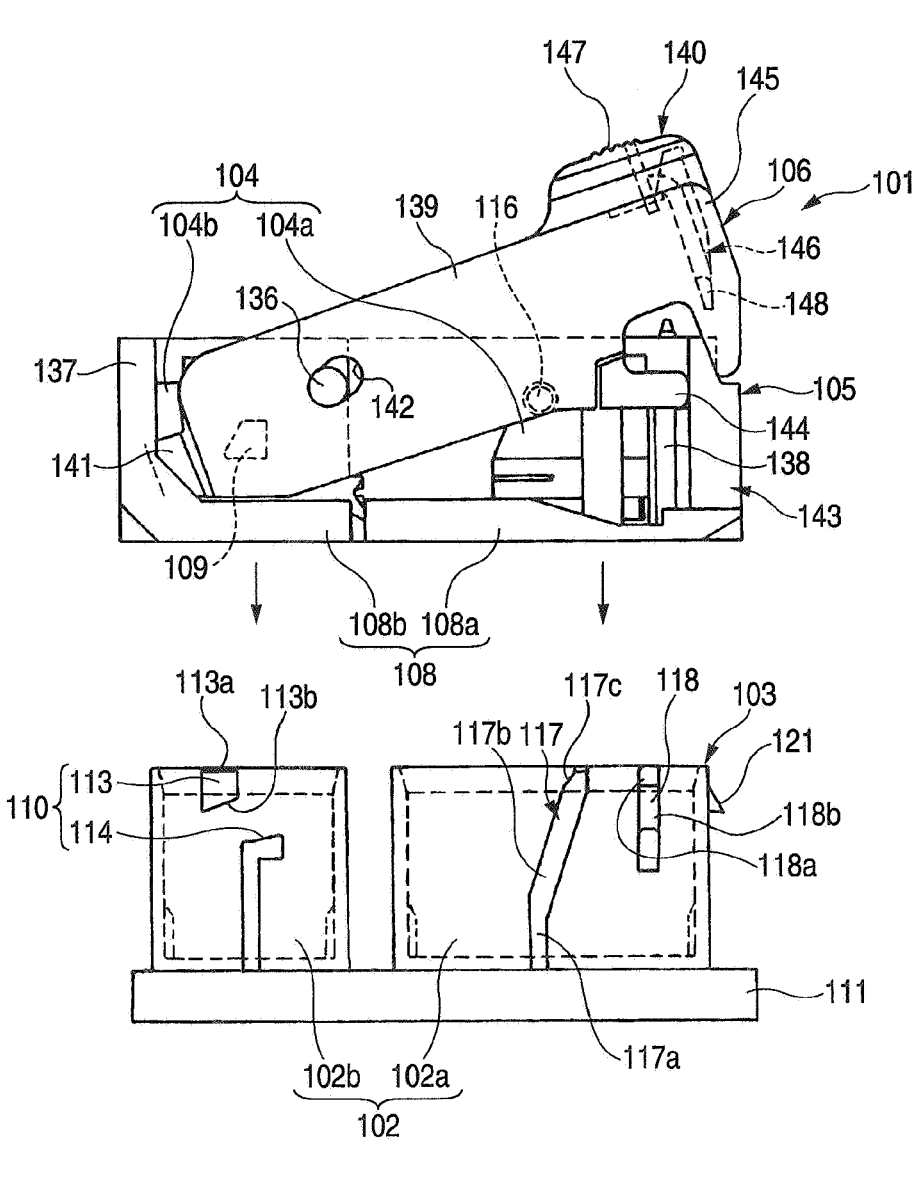
FIG. 12 is a side-elevational view of the lever-fitting type connector disclosed in JP-A-2005-122942.

FIG. 1 is an exploded, perspective view of the preferred embodiment of a lever-fitting type connector of the invention, FIG. 2 is an exploded, perspective view of a lever, FIG. 3 is a perspective view of a female connector having the lever mounted thereon, FIG. 4 is a perspective view of the lever, showing a condition after a lock arm is fixed, FIG. 5 is a front-elevational view of the lever of FIG. 4, FIG. 6 is an enlarged view of a portion of the lever in the vicinity of the lever of FIG. 5, FIG. 7 is a perspective view of the lever, showing a condition before the lock arm is fixed, FIG. 8 is a front-elevational view of the lever of FIG. 7, FIG. 9 is an enlarged view of a portion of the lever of FIG. 8 in the vicinity of the lock arm, and FIG. 10 is a front-elevational view of the lever in its deformed condition.

As shown in FIG. 1, the lever-fitting type connector 2 comprises a male connector 4, the female connector 6, the lever 8, and a wire cover 10. The male connector 4 comprises a male housing 12, a board 14, a male outer cover 16, and a board support base 18. The female connector 6 comprises a female inner housing 20, a female outer housing 22, a female plate housing 24, and a wire seal 26.

The male housing 12 receives a number of male terminals 28 therein, and the male terminals 28 are mounted on the board 14, and therefore are fixed to this board 14. The male terminals 28 are electrically connected to printed wiring (provided at the board 14) and electronic elements mounted on the board 14. The male outer cover 16 is fixed to the board support base 18, with the board 14 interposed therebetween, so that the male housing 12 is disposed at an end portion of the male connector 4.

The female inner housing 20 is formed into a square frame-like shape, and is received within the female outer housing 22 slightly larger in size than the female inner housing 20. Pivot shafts 32 are formed on and project respectively from inner surfaces of a pair of opposed plates 30 of the female outer housing 22.

The female plate housing 24 receives a number of female terminals 34 therein. The female plate housing 24 is inserted into the female inner housing 20 to be received therein, and then by pivotally moving the lever 8, the female inner housing 20 is slid toward the male housing 12 through the female outer housing 22, so that the female terminals 34 are connected respectively to the male terminals 28. Wires (not shown) electrically connected respectively to the female terminals 34 are held watertight by the wire seal 26 attached to the female plate housing 24, and these wires are covered and protected by the wire cover 10 attached to the outside of the female outer housing 22.

The lever 8 comprises a lever base 36 molded of a slightly-elastic resin, and a pair of plates 38 formed of a metal sheet. The lever base 36 includes a pair of side plates 42 each having a cam arm 40, and an interconnecting portion 46 having a lock arm 44. Boss holes 48 and a pivot hole 50 are formed through each of the plates 38.

The lever base 36 has a U-shape as a whole, and has the interconnecting portion 46 at one end thereof, and the side plates 42 extend laterally from upper and lower edges of this interconnecting portion 46, respectively.

The lock arm 44 for being engaged with a lock arm receiving portion 52 formed at the female outer housing 22 is formed at the interconnecting portion 46.

Each of the side plates 42 has a relatively small thickness, and has a generally square or rectangular shape, and the cam arm 40 having a cam groove 54 of a curved slot-like shape projects from a side edge of the side plate 42. A pair of bosses 56 are formed on and project from an outer surface of each side plate 42.

Each of the plates 38 has a relatively small thickness similarly with the side plate 42, and is slightly larger in size than the side plate 42. The pair of boss holes 48 are formed through a plate body 58 (having a flat plate-like shape) of the plate 38, and a projection 60 and the pivot hole 50 are formed at an end portion of the plate body 58.

A reinforcing portion 62 conforming in shape to the periphery of the side plate 42 is formed at an outer edge of each plate 38, the reinforcing portion 62 being formed by bending an edge portion of the plate 38.

The pair of plates 38 are attached respectively to outer surfaces of the pair of side plates 42 of the lever base 36, and by doing so, the bosses holes 48 of each plate 38 are fitted respectively on the bosses 56 of the corresponding side plate 42, with the reinforcing portion 62 covering the periphery of the side plate 42. Thus, each plate 38 is mounted on the corresponding side plate 42 in a unitary manner.

The pivot holes 50 of the plates 38 are fitted respectively on the pivot shafts 32 of the female outer housing 22, so that the lever 8 is pivotally mounted on the female outer housing 22.

When the lever 8 is located in an unlocked position A1 shown in FIG. 3, the female inner housing 20 is inserted between the pair of side plates 42. When the lever 8 is disposed in the unlocked position A1, the female outer housing 22 is provisionally fitted to the male housing 12, and the projections 60 formed respectively at the end portions of the plates 38 are engaged respectively in cams (not shown) formed at the male outer cover 16. Then, the lever 8 is pivotally moved from the unlocked position A1 toward a locked position A2.

As a result, the lever 8 pushes the female inner housing 20 toward the male housing 12. Then, when the lever 8 reaches the locked position A2, the lock arm 44 is engaged with the lock arm receiving portion 52 formed at the female outer housing 22, thus completing the fitting operation.

As shown in FIGS. 7 and 8, the lock arm 44 includes a support shaft portion 64 formed on and projecting from the interconnecting portion 46 of the lever base 36, an extension portion 66 extending from this support shaft portion 64 in a connecting fitting direction, a turned-back extension portion 68 extending in a turned-back manner from an extremity of this extension portion 66 in an anti-fitting direction, and an operating portion 70 formed at an extremity of this turned-back extension portion 68. With a pantograph construction formed by the support shaft portion 64, the extension portion 66 and the turned-back extension portion 68, the lock arm 44 can be resiliently moved out of contact with the interconnecting portion 46.

Excessive displacement prevention piece portions 72 are formed on and project respectively from those portions of opposite side portions of the turned-back extension portion 68 which are offset from the support shaft portion 64 in the anti-fitting direction. Also, displacement limitation ribs 74 are formed respectively at opposite end portions of the interconnecting portion 46 of the lock arm 44, and project in an overhanging manner in a direction away from the side plates 42. As shown in FIGS. 4 and 5, the excessive displacement prevention piece portions 72 are disposed inwardly respectively of the displacement limitation ribs 74 in contiguous relation thereto, and the excessive displacement prevention piece portions 72 are retained respectively by the displacement limitation ribs 74, thereby preventing an excessive displacement of the lock arm 44.

The lever base 36 is injection molded of the elastically-deformable resin, and the lever base 36 is molded, with the lock arm 44 assuming such a pantograph-shape that the lock arm 44 is much spaced from the interconnecting portion 46. Namely, a mold for molding the lever base 36 is so designed that the molded lock arm 44 is formed into an open pantograph-shape. Therefore, a mold section for molding the lock arm 44 does not need to have a small piece or die, and therefore the mold will not become expensive, and besides the strength of the mold will not be decreased in contrast with a mold using such a small piece or die, and there is no fear the mold may be damaged or broken.

Thus, the lever base 36 is injection molded in such a manner that the molded lock arm 44 is kept in the open condition. After the molding of the lever base 36, the free ends of the side plates 42 of the lever base 36 are held with the fingers, and are moved toward each other as indicated by arrows B (FIG. 10), thereby increasing or expanding a gap between the pair of displacement limitation ribs 74, and then the turned-back extension portion 68 is pushed into the expanded gap as indicated by arrow C to thereby insert the excessive displacement prevention piece portions 72 into this wide-open portion. When the excessive displacement prevention piece portions 72 are located closer to the interconnecting portion 46 than the displacement limitation ribs 74 are, the fingers are separated from the free ends of the side plates 42, thereby canceling the expansion of the gap between these free ends, thus achieving a lock arm-fixing condition as shown in FIGS. 4 and 5.

In the above embodiment, the lever base 36, including the lock arm 44 having the excessive displacement prevention function, is injection molded in such a manner that the molded lock arm 44 is formed into the open pantograph-shape, and therefore the lever base 36 can be molded by the mold which does not need to have any small piece or die. And besides, the excessive displacement prevention piece portions 72 of the lock arm 44 are molded to be disposed outwardly respectively of the displacement limitation ribs 74, and therefore a space for receiving the mold section for the excessive displacement prevention piece portions 72 does not need to be secured within a mold section for the displacement limitation ribs, and accordingly the lock arm can be made smaller.

What is claimed is:

1. A method of producing a lever for use in a lever-fitting type connector comprising a female connector including a female outer housing having a female inner housing inserted therein, a male connector including a male housing for fitting to said female outer housing, and said lever which is pivotally mounted on said female connector and is pivotally moved so as to bring said male connector into and out of fitting engagement with said female connector;

wherein said lever includes a pair of side plates, an interconnecting portion interconnecting one ends of said two side plates, a lock arm formed at said interconnecting portion so as to be engaged with said male connector, excessive displacement prevention piece portions formed on and projecting respectively from opposite side portions of said lock arm, and a pair of displacement limitation ribs which are formed respectively at opposite ends of said interconnecting portion, and project in a direction away from said side plates, and are disposed outwardly respectively of said excessive displacement prevention piece portions;

wherein said lever is injection molded in such a manner that those portions of said lock arm at which said excessive displacement prevention piece portions are formed, respectively, are disposed outwardly respectively of said displacement limitation ribs; and free ends of said side plates of the molded lever are moved toward each other so as to bend said interconnecting portion, thereby increasing a gap between said pair of displacement limitation ribs; and said portions having the respective excessive displacement prevention piece portions formed thereon are pushed to be disposed inwardly respectively of said displacement limitation ribs, so that each excessive displacement prevention piece portion is disposed between the corresponding displacement limitation rib and said interconnecting portion, and thereafter said bent interconnecting portion is restored into its initial shape, thereby canceling the expansion of the gap between said displacement limitation ribs.

2. A lever for use in a lever-fitting type connector comprising a female connector including a female outer housing having a female inner housing inserted therein, a male connector including a male housing for fitting to said female outer housing, and said lever which is pivotally mounted on said female connector and is pivotally moved so as to bring said male connector into and out of fitting engagement with said female connector;

wherein said lever includes a pair of side plates, an interconnecting portion interconnecting one ends of said two side plates, a lock arm provided at said interconnecting portion so as to be engaged with said male connector, excessive displacement prevention piece portions formed on and projecting respectively from opposite side portions of said lock arm, and a pair of displacement limitation ribs which are formed respectively at opposite ends of said interconnecting portion, and project in a direction away from said side plates, and are disposed outwardly respectively of said excessive displacement prevention piece portions; and said lever is injection molded in such a manner that those portions of said lock arm at which said excessive displacement prevention piece portions are formed, respectively, are disposed outwardly respectively of said displacement limitation ribs; and free ends of said side plates of the molded lever are moved toward each other so as to bend said interconnecting portion, thereby increasing a gap between said pair of displacement limitation ribs; and said portions having the respective excessive displacement prevention piece portions formed thereon are pushed to be disposed inwardly respectively of said displacement limitation ribs, so that each excessive displacement prevention piece portion is disposed between the corresponding displacement limitation rib and said interconnecting portion, and thereafter said bent interconnecting portion is restored into its initial shape, thereby canceling the expansion of the gap between said displacement limitation ribs.

3. A lever for use in a lever-fitting type connector according to claim 2, wherein said lock arm includes a support shaft portion formed on and projecting from said interconnecting portion, an extension portion extending from said support shaft portion in a connecting fitting direction, a turned-back extension portion extending in a turned-back manner from an extremity of said extension portion in an anti-fitting direction, and an operating portion formed at an extremity of said turned-back extension portion, and said excessive displacement prevention piece portions are formed respectively on those portions of said turned-back extension portion which are offset from said support shaft portion in the anti-fitting direction.

* * * * *